US011623227B2

(12) United States Patent
Alam et al.

(10) Patent No.: US 11,623,227 B2
(45) Date of Patent: Apr. 11, 2023

(54) HYBRID COMPOSITE DISCHARGE ELECTRODE FOR USE IN AN ELECTROSTATIC PRECIPITATOR

(71) Applicant: Ohio University, Athens, OH (US)

(72) Inventors: Khairul Alam, Athens, OH (US); Muhammad Ali, Pickerington, OH (US)

(73) Assignee: Ohio University, Athens, OH (US)

( * ) Notice: Subject to any disclaimer, the term of this patent is extended or adjusted under 35 U.S.C. 154(b) by 768 days.

(21) Appl. No.: 16/485,966

(22) PCT Filed: Feb. 21, 2018

(86) PCT No.: PCT/US2018/018972

§ 371 (c)(1),
(2) Date: Aug. 14, 2019

(87) PCT Pub. No.: WO2018/156594

PCT Pub. Date: Aug. 30, 2018

(65) Prior Publication Data

US 2020/0055058 A1 Feb. 20, 2020

Related U.S. Application Data

(60) Provisional application No. 62/461,403, filed on Feb. 21, 2017.

(51) Int. Cl.
*B03C 3/41* (2006.01)
*B03C 3/08* (2006.01)
(Continued)

(52) U.S. Cl.
CPC ..... *B03C 3/41* (2013.01); *B03C 3/08* (2013.01); *B03C 3/64* (2013.01); *B03C 3/16* (2013.01); *B03C 2201/10* (2013.01)

(58) Field of Classification Search
CPC combination set(s) only.
See application file for complete search history.

(56) References Cited

U.S. PATENT DOCUMENTS 3,819,985 A * 6/1974 Dusevoir ..... B03C 3/41 96/96
7,976,616 B2 * 7/2011 Alam ..... B03C 3/62 96/97

(Continued)

FOREIGN PATENT DOCUMENTS

JP 5858162 A 4/1983
JP H08112549 A * 5/1996 ..... B03C 3/60

OTHER PUBLICATIONS

Translation of JP58 58162 (Year: 1983).*

(Continued)

*Primary Examiner* — Christopher P Jones
*Assistant Examiner* — Sonji Turner
(74) *Attorney, Agent, or Firm* — Wood Herron & Evans LLP

(57) ABSTRACT

A hybrid composite discharge electrode (HCDE) (20) includes at least one metal layer (22) and at least one carbon fiber layer (26). The HCDE (20) improves the stability and uniformity of the corona while being corrosion-resistant, lightweight, and compact. Additionally, a method of making a HCDE (20) is provided. In another aspect, an electrostatic precipitator (60) is provided and includes a hybrid composite discharge electrode (62).

14 Claims, 11 Drawing Sheets

(51) Int. Cl.
*B03C 3/16* (2006.01)
*B03C 3/64* (2006.01)

(56) References Cited

U.S. PATENT DOCUMENTS

| | | | | |
|---|---|---|---|---|
| 9,114,404 | B2 * | 8/2015 | Alam | B03C 3/60 |
| 2008/0190296 | A1 | 8/2008 | Alam | |
| 2010/0240943 | A1 * | 9/2010 | Solnik | C02F 1/46109 204/554 |

OTHER PUBLICATIONS

Ali, M. et al., "Novel hybrid composite discharge electrode for electrostatic precipitator," Journal of the Air & Waste Management Association (2017) 67(9), 6 pgs.
International Search Report and Written Opinion in International Patent Application No. PCT/US2018/018972, dated Apr. 13, 2018, 7 pgs.

* cited by examiner

HYBRID COMPOSITE DISCHARGE ELECTRODE FOR USE IN AN ELECTROSTATIC PRECIPITATOR

TECHNICAL FIELD

The present invention relates generally to discharge electrodes and, more specifically, to hybrid composite discharge electrodes for use in electrostatic precipitators.

BACKGROUND

An electrostatic precipitator (ESP) is utilized for particulate removal from a large flow of exhaust gases. As an example, control of particulate emissions in exhaust gases at a coal-fired power station is often achieved by charging the particles with a corona produced by discharge electrodes and then driving the particulate to grounded collector plates. ESPs are capable of collecting particulate less than 2.5 μm in size. Removal efficiencies of greater than 98% can be achieved in an ESP. Specifically, wet electrostatic precipitators (WESPs) are capable of collecting very small particles with high efficiencies. WESPs are also useful for removal of toxic vapors and mists.

The performance of ESPs mainly depends on the discharge electrode design and spacing between discharge electrode and grounded plate. ESPs are typically made of metal, and the corona current emitted from them charge the particles, which are then collected on grounded surfaces. The charging of the particles and the collection efficiency are improved by uniform distribution of a stable corona current. Typically, the corona current is emitted from sharp points also known as "emitters" on the discharge electrode. Corona discharge is controlled primarily by the electrode geometry, orientation, emitter geometry, and electrode distance from the grounded plate. The uniform distribution of the corona current is also an important characteristic of the discharge electrode design. Wire discharge electrodes have been commonly used until the advent of rigid discharge electrodes, such as those shown in FIG. 1. The most effective electrodes have emitters facing the flow direction.

The need for corrosion resistant discharge electrodes arose with the development of WESPs, in which the exhaust stream is cooled enough to be saturated with water vapor. The electrodes used in a typical WESP must be made of corrosion resistant alloys, which make them expensive and heavy. With the increase in cost of corrosion resistant alloys and the decrease in the cost of carbon fibers, there has been an increased interest in carbon fiber composites for many applications. Although carbon fiber has been studied for discharge electrode applications, it must be used as a composite in the ESPs because structural rigidity is needed for the electrode. Carbon fiber composites have high specific strength, specific modulus, low density, and excellent corrosion resistance and application flexibility.

One of the concerns with a carbon fiber composite electrode is electrical conductivity, which tends to be inadequate in the through-thickness direction of the composite. There have been several developments to improve the through-thickness conductivity of carbon fiber composites. For example, during the manufacturing process, an increase in curing pressure can produce a decrease in the contact resistivity. The contact conductivity or the through-thickness conductivity is important for improving the hybrid electrode electrical performance. The manufacturing process affects the average value of the through-thickness conductivity. In addition, a resin-rich film prevents the contact between the carbon fibers and reduces the electrical conductivity in the through-thickness direction.

Considering the above, there is a need for improved composite discharge electrodes and methods for making composite discharge electrodes that address one or more of the drawbacks above.

SUMMARY

In an aspect of the present invention, a hybrid composite discharge electrode (HCDE) is provided and includes at least one metal layer and at least one carbon fiber layer. The HCDE improves the stability and uniformity of the corona while being corrosion-resistant, lightweight, and compact. In another aspect, an electrostatic precipitator is provided and includes a hybrid composite discharge electrode.

In an aspect of the present invention, a method of making a hybrid composite discharge electrode is provided and includes combining at least one metal layer and at least one carbon fiber layer to form the hybrid composite discharge electrode.

The objects and advantages of present will be appreciated in light of the following detailed descriptions and drawings in which:

DETAILED DESCRIPTION

Embodiments of the present invention are directed to hybrid composite discharge electrodes (HCDEs). HCDEs are a lightweight and corrosion resistant alternative for traditional metal alloy electrodes in electrostatic precipitators (ESPs), such as wet electrostatic precipitators (WESPs). Further embodiments are directed to ESPs including a HCDE. Further embodiments are directed to methods of making a HCDE.

A hybrid composite discharge electrode according to the present invention combines the complementary properties of a metal and carbon fiber. Metals resist abrasion, while carbon fibers are very good at emitting a corona. Metal-carbon fiber composites also provide excellent stiffness and corrosion resistance, which is very desirable for WESPs. A HCDE provides a very uniform corona that does not spark very readily and produces the corona at a lower voltage. Sparking reduces the particle collection efficiency of an ESP. The corrosion-resistant HCDE is lightweight, with high stiffness and abrasion resistance.

In an embodiment, a hybrid composite discharge electrode may include at least one carbon fiber composite layer combined with a metal mesh in the shape of a long and thin tape. As described further in Example 1, a HCDE's electrical properties were tested in open atmospheric conditions, while connected to a transformer-rectifier to generate a corona current at voltages up to 50 kV and were compared with traditional metal electrodes. The HCDE produced a uniform corona at comparable power levels to that of traditional metal electrode with additional advantages of being compact, lightweight, and highly corrosion resistant. In addition, hybrid composite discharge electrodes exhibited lower corona onset voltage as compared to metal electrodes.

Figure 2:
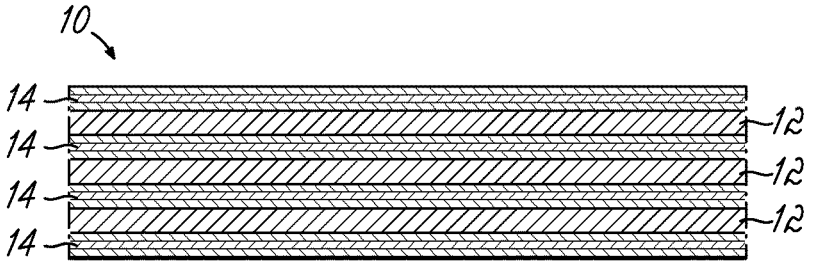
FIG. 2 is a schematic showing alternating metal mesh and carbon fiber layers in a hybrid composite discharge electrode according to an embodiment of the present invention.

With reference to FIG. 2, in an embodiment, an HCDE 10 includes at least one layer of metal mesh 12 inserted between more than one layer of carbon fiber composite 14 (i.e., carbon fiber/resin layers or pre-pregs). The metal mesh layers 12 provide an excellent conductive path for the current and protect the inner composite layers 14 from abrasion by moving particles. The exposed ends of the carbon fiber layers, which are protected by the metal mesh, tend to produce most of the corona. The corona is produced by both the carbon fibers and the metal mesh. The result is a very uniform corona with high corona current.

The uniform corona field generated by the hybrid composite discharge electrode as compared to the point corona typical of metal electrodes impacts the collection efficiencies or electrostatic precipitators. Traditional metal electrodes have several discharge points or emitters along the length thereof (e.g., as shown in FIG. 1), which emit the visible coronas. In a hybrid composite discharge electrode such as HCDE 10, there are thousands of fibers running the length of the electrode and perpendicular to the electrode, which all act as tiny emitters. Those micro emitters easily release electrons and reduce ozone generation. During testing, many of the HCDE samples had uniform to mostly uniform corona fields up to 95% of the power range. In contrast, metal electrodes often have only a few of the emitters generating corona at any given time. This is expected to improve the collection efficiency. The uniform corona densities will lead to more particulates being charged even at lower power levels or at shorter distances from the plate. It has been shown that corona uniformity has a positive impact on the charging and the migration velocities of the particles. The hybrid composite discharge electrodes have the advantages of providing uniform corona with a simple design, since it hard to design and fabricate the spark emitters of the conventional metal electrodes. It should be recognized that there are many variables involved that may change the performance of a discharge electrode. Those variables include but are not limited to, orientation of the spark emitters, spacing between the grounded plate and the discharge electrode, pressure and temperature inside the ESP, spacing between the discharge electrodes, spacing between the spark emitters, dimension of the discharge electrode, shape of the spark emitters, type of dust particles and their diameter, and the accumulation of the dust on both the grounded plate and the discharge electrode.

The number and configuration of layers in the HCDE 10 may vary. In an embodiment, with reference to FIG. 2, the layers of metal mesh and carbon fiber composite alternate. In another embodiment, there may be from 3 to 10 layers of carbon fiber composite and from 2 to 6 layers of metal mesh. The shape of the HCDE may vary depending on the materials used and the application. For example, the shape of the HCDE may be a thin bar or a cylinder of different cross-sections. An example of an advantageous shape would have a V-shaped cross section perpendicular to the length of the HCDE so that it produces a streamlined profile to the flow of gases, thereby reducing the pressure drop.

The carbon fiber composite layers 14 increase the stiffness of the HCDE 10 because carbon fibers are much stiffer than, for example, steel. The HCDE 10 is compact and light and, in an ESP, uses a frame to keep the HCDE 10 in tension in the vertical direction depending on the ESP. The frame helps reduce vibrations caused by flow of gases and by other equipment such as a draft fan. If more stiffness of the vertical electrodes is desired, in an embodiment, one or more cross bars or horizontal electrodes can be used into which the vertical electrodes are inserted to prevent horizontal movement.

In an embodiment, a hybrid composite discharge electrode is fabricated from carbon fiber-epoxy composite and metal wire mesh in the shape of a long, thin tape. A corona may be generated at each carbon fiber filament, and the HCDE may yield corona fields that are denser and more uniform. The metal mesh (e.g., a wire mesh) serves a dual role: as a conductive spine within the composite and as the connecting point for the high voltage supply. The metal mesh also provides spaces in the pores for extra resin to flow during curing under pressure, which leads to a good conductive contact or between the metal mesh and the carbon fibers. As a result, the contact resistivity between the metal substrate and the carbon layers decreases.

The metal used in embodiments of the present invention may vary. For example, the metal may be stainless steel 60×60 mesh. Other types of metal include 80×80 mesh, perforated plates, and or solid (i.e., non-perforated) metal tapes or bars can be used. The metal may include corrosion resistant alloys such as 304 stainless steel, 416 stainless steel, or Hastelloy C2000.

The carbon fiber used in embodiments of the present invention may vary. For example, the carbon fiber may be in the form of a fabric using tows of different number of fibers (e.g., 3 k, 6 k, etc.). The fabric may have different types of weave such as a plain weave fiber fabric (e.g., AS4 3 k plain weave carbon fiber cloth), twill weave carbon fiber fabric, or a unidirectional carbon fiber tapes. In addition, other fibers may be added to improve properties of the electrode.

The epoxy or polymer matrix used in embodiments of the present invention may vary. The epoxy may be, for example, Fibre Glast 2000 with 2120 hardener, and the polymer matrix may be, for example, polypropylene. Since the matrix acts as an insulator, it increases the resistance between the carbon fiber layers. To address this, a conductive epoxy (CE), such as Carbon-Bond 61 LP, may be used to aid in the through-thickness conductivity.

FIGS. 3A-6 illustrate HCDEs according to various embodiments including at least one carbon fiber composite layer and traditional metal discharge tips or pins to provide dual corona sources for a stable, uniform corona. The carbon fiber composite layer at least partially covers the metal discharge tips.

Figure 3A:
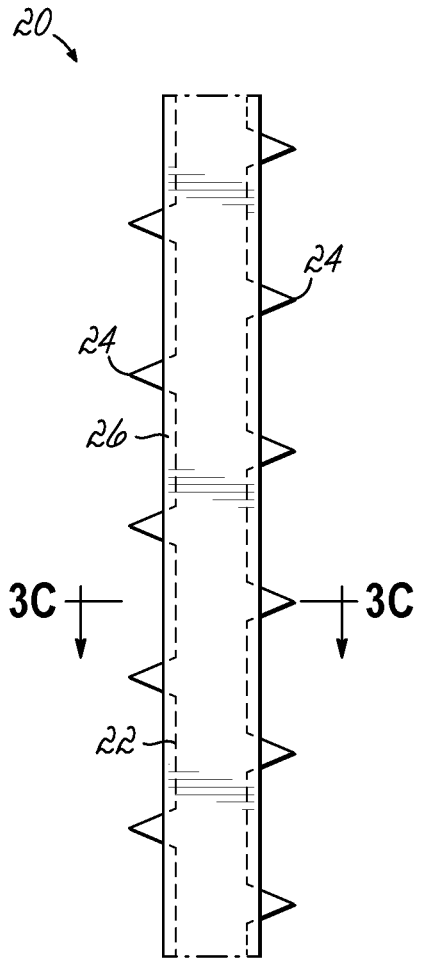
FIGS. 3A and 3B are side views of a hybrid composite discharge electrode including metal discharge tips according to an embodiment of the present invention.
Figure 3B:
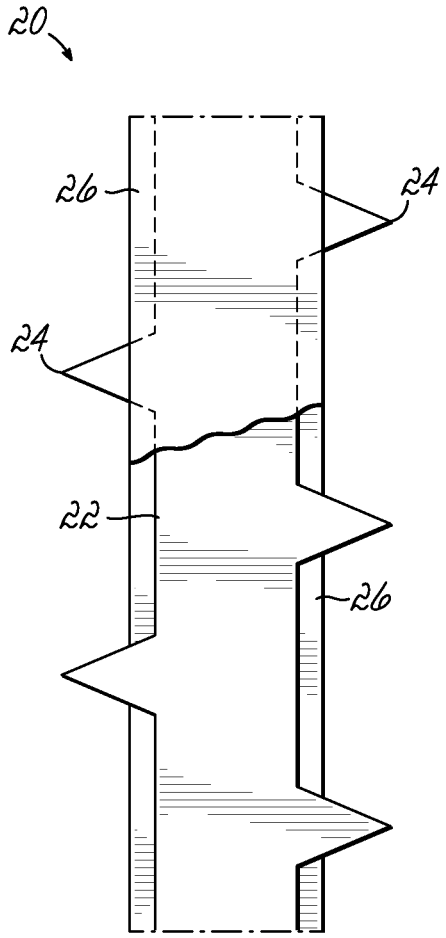
Figure 3C:
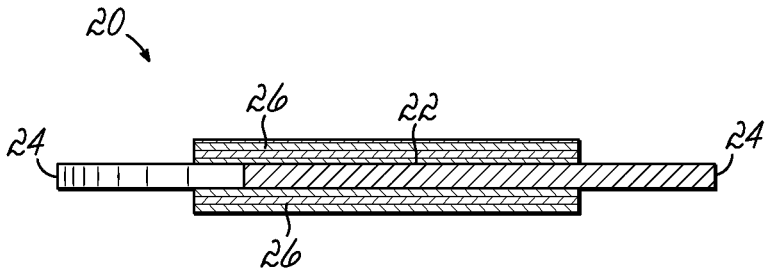
FIG. 3C is a cross-sectional view of the hybrid composite discharge electrode of FIG. 3A.

With reference to FIGS. 3A-3C, in an embodiment, an HCDE 20 includes a metal electrode base 22 including metal discharge pins or tips 24 (e.g., as shown in FIG. 1) sandwiched between two carbon fiber composite layers 26. In this HCDE, the metal discharge tips 24 can produce a corona along with the carbon fibers in the composite layers 26. This HCDE 20 will be much lighter and stiffer than a metal electrode of similar structural properties due to the composite sandwich construction and also will provide a stable, uniform corona over a wide range of voltages.

Figure 4A:
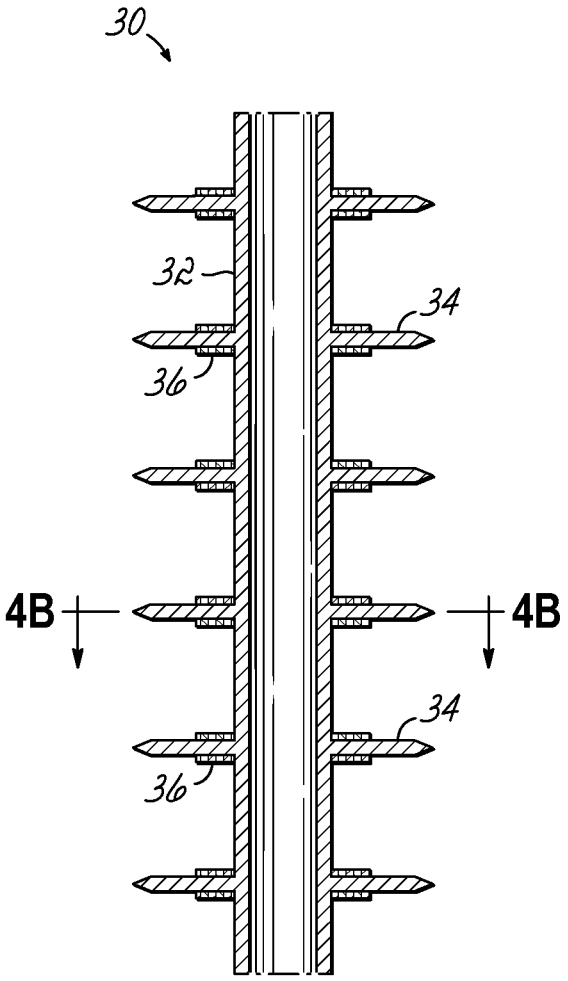
FIGS. 4A and 4B are side and cross-sectional views, respectively, of a hybrid composite discharge electrode including metal discharge tips according to another embodiment of the present invention.
Figure 4B:
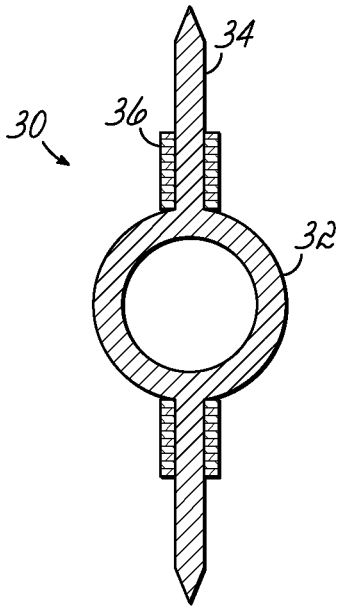
Figure 5A:
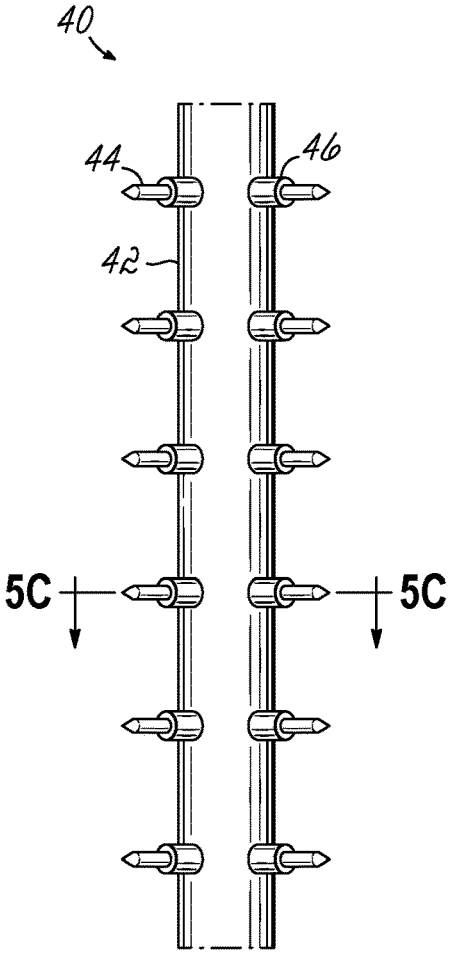
FIGS. 5A-5C are side, perspective, and cross-sectional views, respectively, of a hybrid composite discharge electrode including metal discharge tips according to another embodiment of the present invention.
Figure 5B:
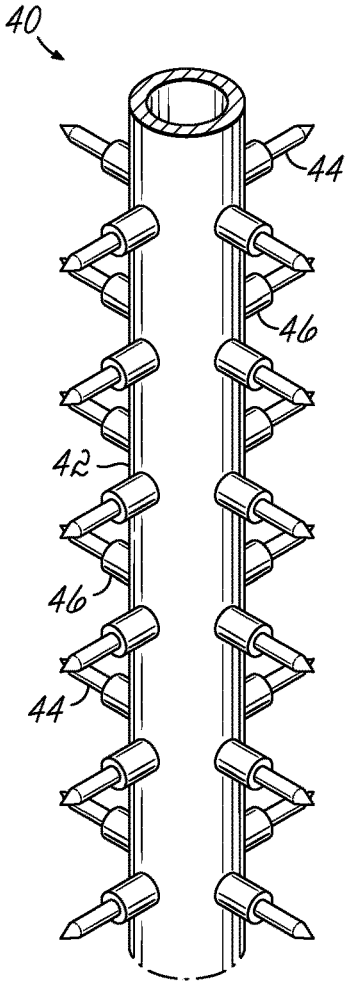
Figure 5C:
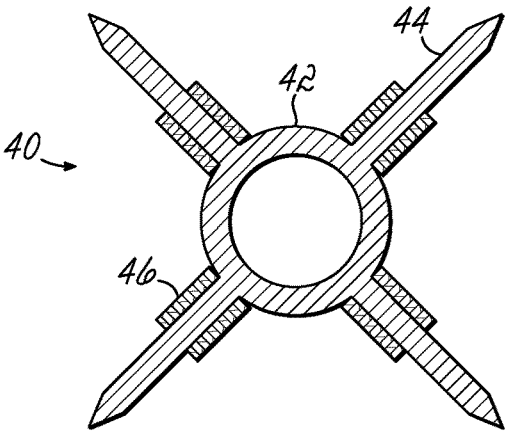

With reference to FIGS. 4A and 4B, in an embodiment, a HCDE 30 includes a metal electrode base 32 including metal discharge pins or tips 34, each of which includes a carbon fiber composite layer 36 covering a portion of the metal discharge pin or tip 34. The metal electrode base 32 includes pairs of metal discharge tips 34 spaced along the length thereof. The number and arrangement of metal discharge tips 34 may vary. In an embodiment, and with reference to FIGS. 5A-5C, a HCDE 40 includes a metal electrode base 42, which is a circular rod support, having sets of four metal discharge tips 44 spaced along the length thereof. The metal pins are at least partially covered by carbon fiber composite layers 46.

Figure 6:
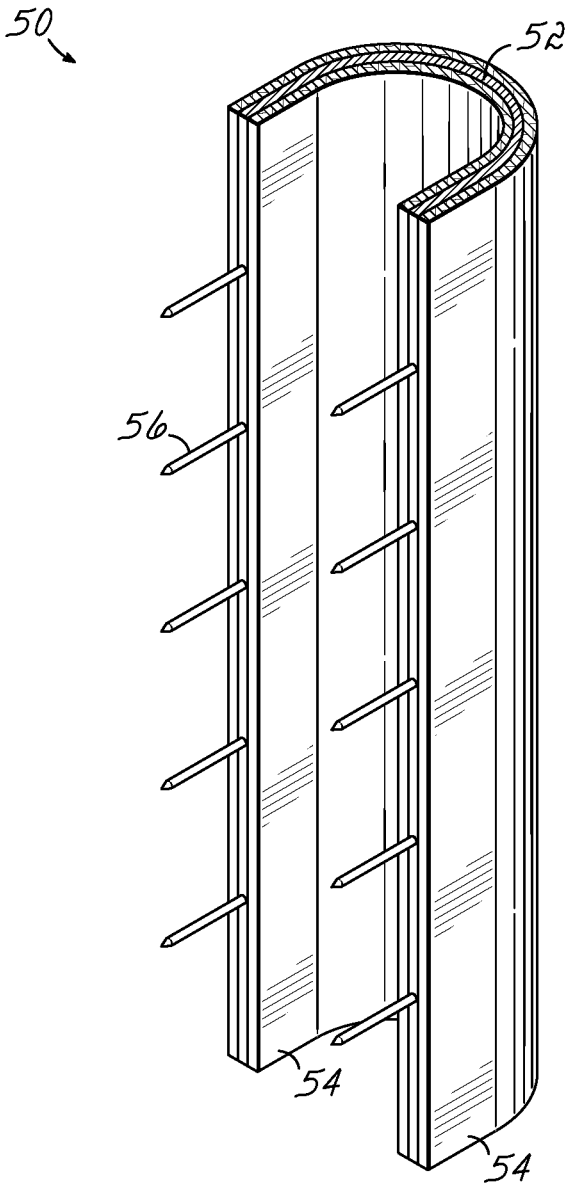
FIG. 6 is a perspective view of a hybrid composite discharge electrode including metal discharge tips according to another embodiment of the present invention.

With reference to FIG. 6, in an embodiment, a HCDE 50 has a streamlined shape designed to reduce pressure drop in the ESP. More specifically, the HCDE 50 includes a metal layer 52 positioned between two carbon fiber composite layers 54. The metal layer 52 may be a mesh. The cross-section of the HCDE 50 is U-shaped. The HCDE 50 includes metal pins 56 extending from the metal layer 52 along the length of the HCDE 50. While the metal pins 34, 44 shown in FIGS. 4 and 5 extend radially from the metal electrode base 32, 42, the metal pins 56 extend in the same direction away from the HCDE 50 due to the shape of the HCDE 50.

It should be recognized that various methods of fabricating an HCDE may be used. In an embodiment, a HCDE may be fabricated using a hand lay-up vacuum bagging method. In another embodiment, a compression molding manufacturing process may be used to fabricate a HDCE. In another embodiment, an assembly of metal mesh layers and carbon fiber composite layers may be cured. During curing, the resin bleeds into the metal mesh and produce a strong hybrid composite. The curing temperature may depend on the resin used, and the pressure may be equal to one or more atmospheres. The total thickness the HCDE layers may vary from, for example, 1 mm up to 10 mm.

Figure 7:
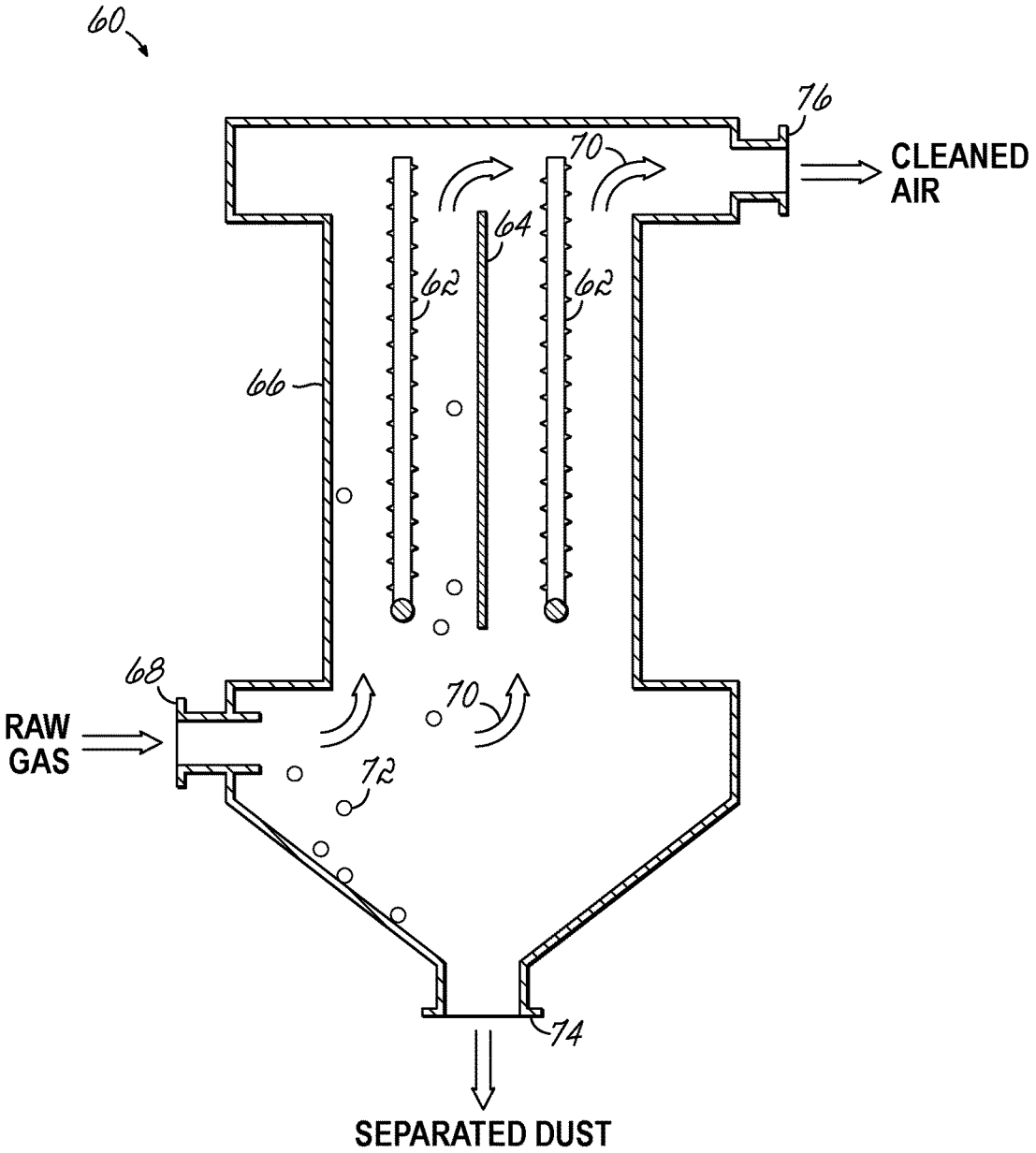
FIG. 7 is a cross-sectional view of an electrostatic precipitator according to an embodiment of the present invention.

With reference to FIG. 7, in an embodiment, an electrostatic precipitator 60 includes a hybrid composite discharge electrode 62. The electrostatic precipitator 60 also includes a grounded collector 64. The HCDE 62 and the grounded collector 64 may be housed in a chamber 66, and a voltage can be applied between the HCDE 62 and the grounded collector 64 to produce a corona. Gas enters the chamber 66 through a gas inlet 68 and flows past the HCDE 62 (as shown by arrows 70) where particles 72 in the gas are charged by the corona and driven towards the grounded collector 64. The collected particles 72 may then fall towards a particle outlet 74, while the cleaned gas exits through a gas outlet 76. The type of ESP may vary. For example, a compact horizontal WESP may include a hybrid composite discharge electrode. In another embodiment, an ESP with a cross flow system may include a hybrid composite discharge electrode. In an embodiment, a vertical ESP can have a HCDE in the shape of a cross. An electrical connection to a power supply may be made by connecting to the metal mesh ends of the HCDE. Further, the particles removed from the gas may vary and may include, for example, heavy metals, condensed acid aerosols, or condensed volatile organic compounds.

In order to facilitate a more complete understanding of the embodiments of the invention, the following non-limiting examples are provided. Several composites processing techniques were used to manufacture HCDEs. These electrodes were then compared to metal electrodes using common electrode metrics.

Example 1

Hybrid Composite Discharge Electrode Fabrication. Hybrid composite discharge electrodes were produced with continuous carbon fibers having an electrical resistivity of $1.8\times10^{-3}$ Ohms-cm. Hand lay-up vacuum bagging, compression molding and autoclave curing of pre-pregs were used to fabricate the HCDE samples. Carbon fiber reinforced epoxy pre-preg sheets (VTP DA100) were used with metal mesh to make electrodes using compression molding in a hot press. The samples from this type were called hybrid pre-preg electrode. Plain weave carbon fabric with 3 k carbon fiber tows were fabricated with an epoxy matrix using hand lay-up vacuum bagging method. The samples from this type were called hybrid hand lay-up electrode. Thermoplastic composites were also made using unidirectional carbon fiber with polypropylene matrix sample and were fabricated using compression molding. The samples from this type were called hybrid polypropylene electrode or hybrid PP electrode. All of the hybrid composite discharge electrodes had the same configuration: three stainless steel 60×60 mesh and four carbon fiber layers as shown in FIG. 2. The thickness of both the metal and the hybrid composite discharge electrodes was 0.08 inch.

Figure 8A:
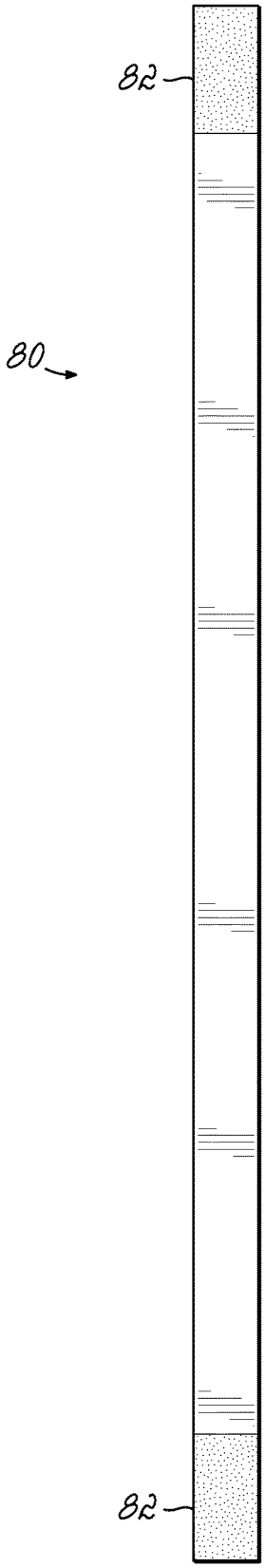
FIGS. 8A and 8B are schematic views of hybrid composite discharge electrodes according to various embodiments of the present invention.
Figure 8B:
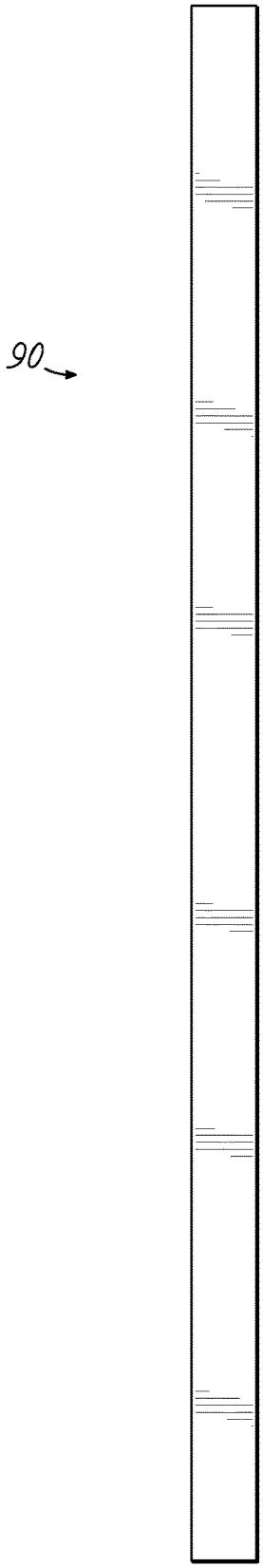

The conventional epoxy matrix acts as an insulator, increasing the resistance between the fiber bundles, in order to compensate for this factor, a conductive epoxy (CE), Carbon-Bond 61 LP, was used to aid in the through-thickness conductivity. The samples from this type were called hybrid hand lay-up with CE electrode. In FIGS. 8A and 8B, the hybrid hand lay-up with CE electrode 80, with exposed conductive epoxy ends 82, and the hybrid pre-preg electrode 90, respectively, are shown. Each of the electrodes 80, 90 were 36" long and 1.25" wide. On the electrode 80, the conductive epoxy ends each had a length of 3".

Figure 1A:
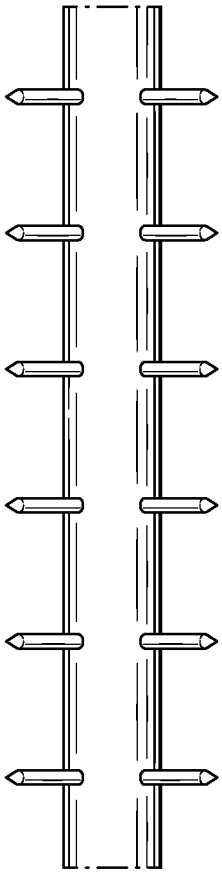
FIG. 1A PRIOR ART
FIGS. 1A-1D are side views of prior art metal discharge electrodes.
Figure 1B:
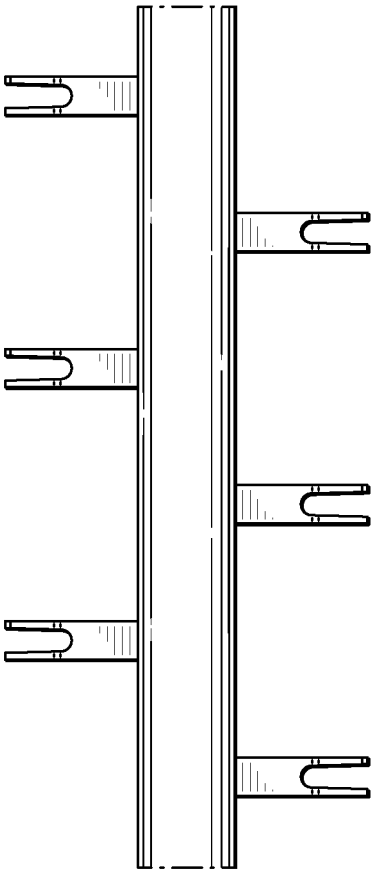
FIG. 1B PRIOR ART
Figure 1C:
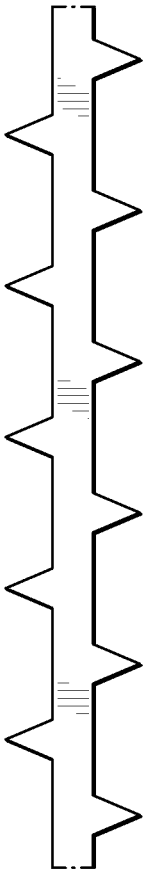
FIG. 1C PRIOR ART
Figure 1D:
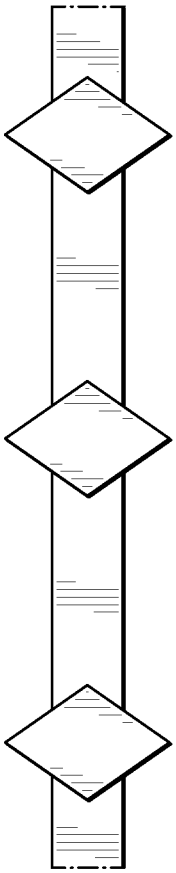
FIG. 1D PRIOR ART

Conventional Metal Electrode Fabrication. A spiked metal electrode as shown in FIG. 1D was used for the following reasons: 1) the design of this electrode was considered as a controlled corona type electrode which was similar to the hybrid electrode. The metal electrode was made using plain carbon steel tapes with steel pallet banding material cut into trapezoid shapes which were then welded to the steel tape. The spacing between discharge tips was approximately 2 inches. The selection of the metal electrode configuration depends on many factors such as the temperature and pressure inside ESP, dust particulate size, etc. Metal electrodes are available in variety of configurations. For example, three metal electrodes (c), (d), and (e) are described in published literature and each include metal discharge tips spaced along the length of the electrodes, similar to the electrode shown in FIG. 1D.

Electrode Testing Method. To compare the electrodes performance, V-I curves were generated for all samples. In all cases, measurements were taken from the effective edge or emitters of the electrodes. The voltage was steadily ramped and the voltage and current were recorded. The purpose of conducting the tests was to study the V-I characteristics of the samples. The maximum voltage and current were recorded at the spark point-spark over. Steady state power tests were also conducted for all samples at various distances from the grounded plate. The V-I characteristic test was conducted for each electrode at 7", 8", and 9" from the grounded plate. The steady state power is the product of the maximum voltage and current that the electrode can hold before sparking occurs. Further testing was conducted to record the onset corona voltage and the corona uniformity. The corona onset voltage was recorded when it started to be visible.

The tests were conducted using the Hipotronics Hipot tester 8100-10-A and custom built test rig. The Hipotronics Hipot tester 8100-10-A with negative polarity was used to apply the voltage. The custom built test rig included a grounded stainless steel plate and electrodes held tight on an electrical grade (GPO3) fiberglass rig. The plate was 3.5 feet wide and 6 feet tall. The electrode fiberglass rig was of the same size as the grounded plate. The distance between the electrodes and the plate was kept flexible and ranged from 6 to 9 inches. Two digital multi-meters were used to record both the voltage and the current. The tests were conducted outside of the ESP chamber to eliminate the effect of other factors inside the ESP such as the temperature, dust particles accumulation, and pressure to name a few. The data was collected at repeatable environmental conditions, since both the humidity and the temperature affect the spark over current and voltage values.

Figure 9:
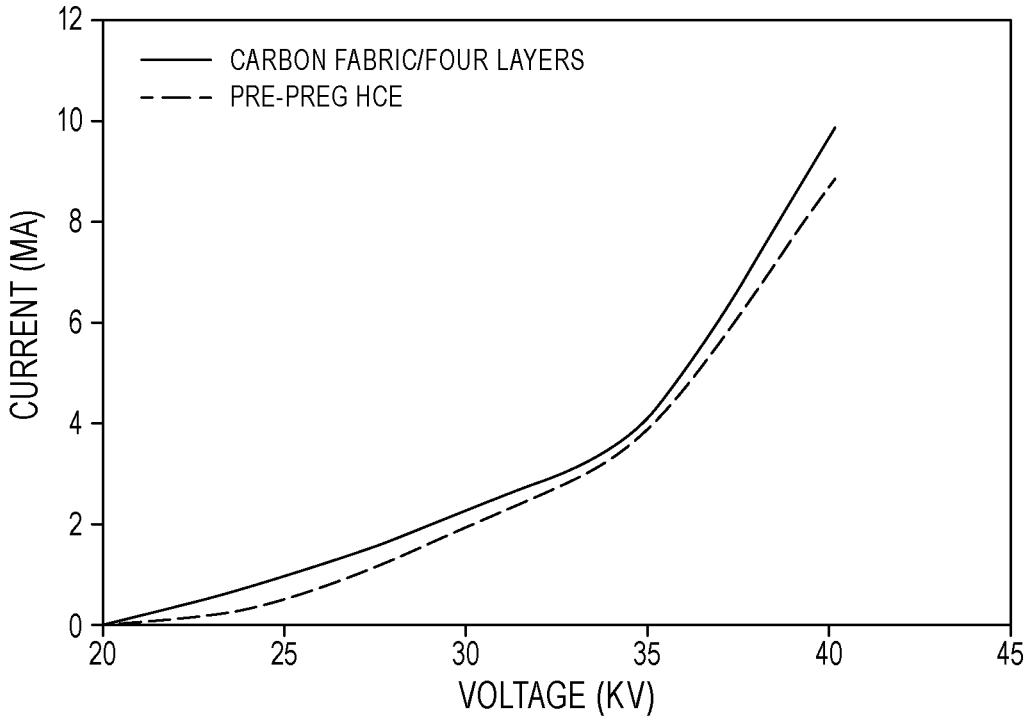
FIG. 9 is a V-I graph comparing a non-hybrid composite electrode with a hybrid composite discharge electrode.

Testing Results. The baseline testing results for two composite electrodes are shown in FIG. 9. The non-hybrid electrode was made of thermoset composite with four layers of plain woven carbon fabric using 3K tows. The hybrid pre-preg composite was made with four layers of carbon fabric alternating with three metal mesh layers (as shown in FIG. 2). The results show that the hybrid composite performs better; and is much stiffer. Therefore, most of the tests were conducted with the hybrid pre-preg composite electrode.

Figure 10:
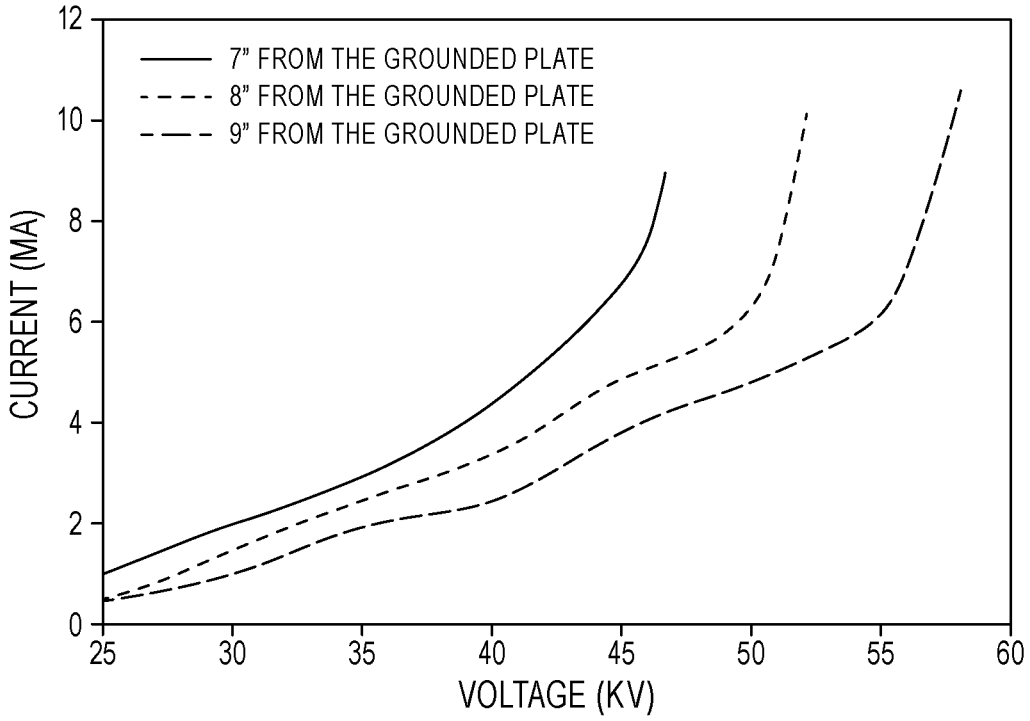
FIG. 10 is a V-I graph showing results for a conventional metal electrode.
Figure 11:
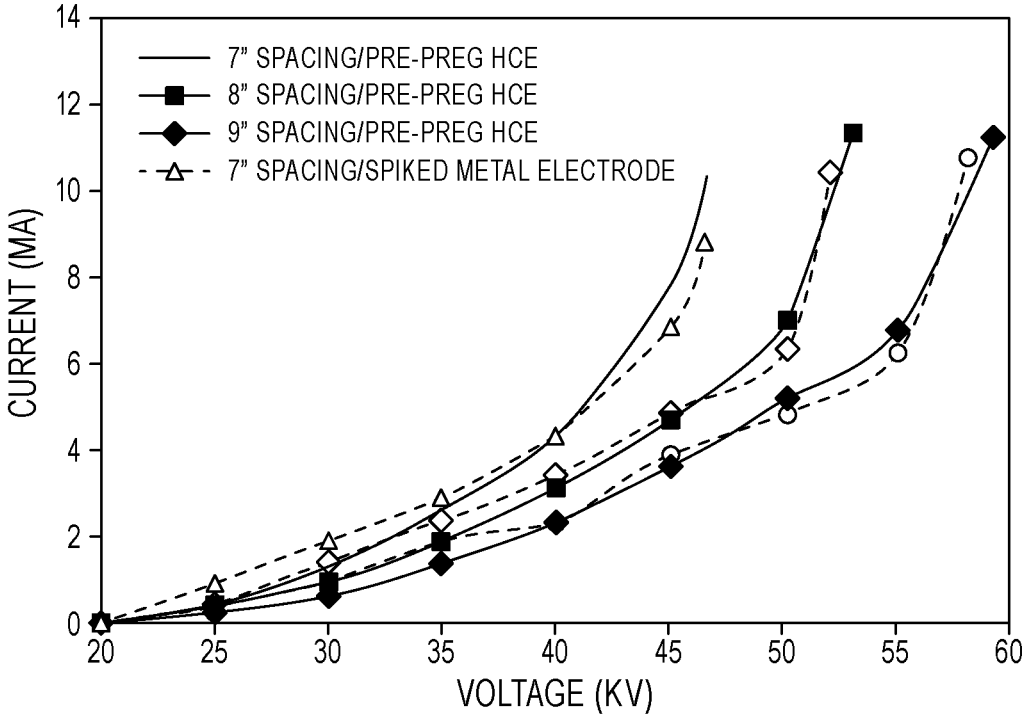
FIG. 11 is a comparison of V-I curves of a metal electrode and a hybrid pre-peg composite electrode.

FIG. 10 shows the V-I curve for the metal electrode. FIG. 11 compares the V-I characteristics of the metal electrode vs. the hybrid pre-preg electrode. The V-I curve for each electrode type is averaged for two or more tests. From the shape of the V-I curves, the corona current decreases as the distance between the grounded plate and the discharge electrode increases. Increasing the corona current will increase the ESP collection efficiency.

Figure 12:
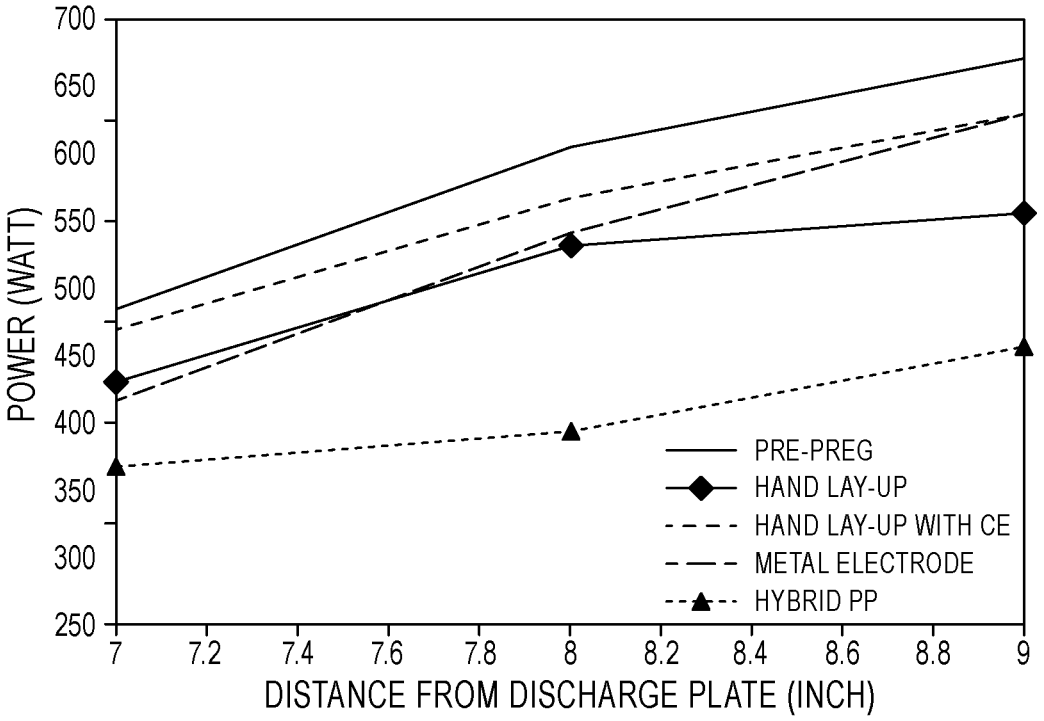
FIG. 12 is a graph showing the average peak power at different distances from the grounded plate for the metal electrode and hybrid composite discharge electrodes of various embodiments.

FIG. 12 indicates the peak power at the spark over voltage and current for all of the discharge electrode samples previously discussed. The distance to the grounded plate varied from 7 to 9 inches. The hybrid pre-preg electrode has the highest power among all of the samples, whereas the hybrid polypropylene electrode has the lowest power. The metal electrode power is higher than both the hybrid polypropylene and hybrid hand lay-up electrodes. The result indicates the effect of using the CE at the ends of the hybrid hand lay-up electrode.

Table 2 summarizes the voltage, current, and power for the different electrodes with different widths. In testing the steady state of the samples, the voltage was raised and held below the spark over point for more than 30 sec. All tests were conducted at 6" distance from the grounded plate. It was determined that all of the hybrid electrodes provide a stable current over time, whereas the metal electrode current fluctuates over time, reaching high levels at sparking onset. The hybrid pre-preg electrode and the hybrid hand lay-up with the conductive epoxy (CE) electrodes have comparable values with the metal electrode, but the corona was much more stable.

TABLE 2

| Electrode Samples | Width (inch) | Current (mA) | Voltage (kvdc) | Power (Watt) |
|---|---|---|---|---|
| Metal electrode | 1.25 | 9.5 | 40 | 380 |
| Hybrid pre-preg | 1.25 | 9 | 43 | 387 |
| Hybrid hand lay-up with CE | 1.25 | 9.5 | 41.6 | 395 |
| Hybrid hand lay-up | 1.25 | 8.5 | 40.0 | 340 |
| Hybrid pre-preg | 0.5 | 9.5 | 40.2 | 381 |
| Hybrid hand lay-up | 0.5 | 7.5 | 39.9 | 300 |

Figure 13:
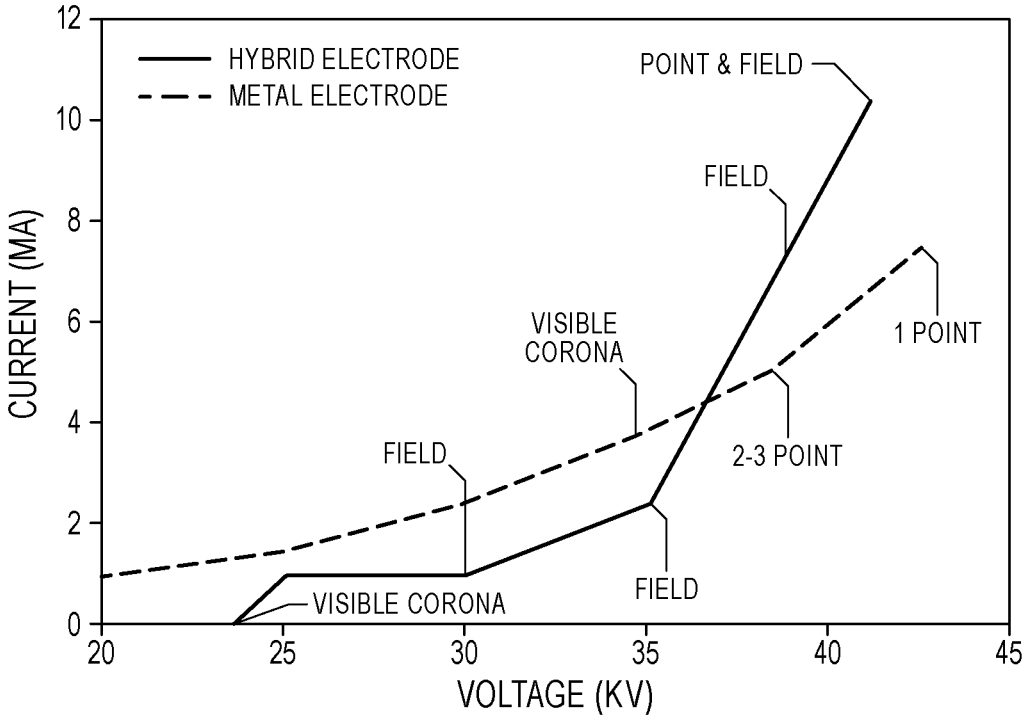
FIG. 13 is a graph showing the average corona onset voltages for a metal electrode and hybrid composite discharge electrodes according to various embodiments.

To test the corona onset, a UV full spectrum camera was used to monitor the corona starting point (i.e., when the corona becomes visible). FIG. 13 indicates that the visible corona discharge started at 23 kVDC for the hybrid hand lay-up electrode, whereas the visible corona discharge started to be visible at 34 kVDC for the metal electrode. Additionally, the pattern of the corona discharge is indicated. The metal electrode does not have visible uniform corona, while the hybrid electrode has a uniform or field corona discharge. For the metal electrode, the three point corona covered approximately 8 inches of the 36-inch electrode length. The position of the point corona changed from one position to another randomly. The corona was visibly more uniform over the hybrid composite discharge electrode at different conditions.

The results show that the performance of the hybrid electrode was better than the metal electrode sample. One can assume that hybrid electrodes should have at least similar collection efficiencies as metal electrodes, since the electrical performance on the V-I curve is one of the most widely used metrics for assessing the performance of an electrode.

Along with the uniform corona, the corona onset voltage of the hybrid composite discharge electrodes also differed from the metal sample as seen in FIG. 13, which shows the effect of the electrode material on the corona onset voltage. For the hybrid composite discharge electrodes, the corona was visible at 24 Watts versus the metal electrode being visible at 130 Watts. Since the visible corona is an indication of particles being charged and evidence that electron flow has been initiated, it is possible to conclude that a hybrid electrode would have higher collection efficiencies at lower voltages. The hybrid composite discharge electrodes exhibit a steady power even just before discharge. During the steady state hold test, the metal electrode tends to fluctuate greatly just before discharge. These fluctuations in the power of the metal electrode occurred just after the corona started being emitted by a single point. In the hybrid discharge electrode, the corona underwent fluctuation only at the spark point, but the corona on the remaining total length of the electrode was quite stable.

The results discussed above demonstrate that the HCDE can produce current at high voltages and, at the same time, produce a stable, uniform corona over a wide range of voltages. A stable, uniform corona can be highly beneficial in electrostatic precipitators where voltages are controlled to go up and down to control sparking. The composite part of the hybrid electrode will generate a good corona at the lower voltages. Depending on the application, an HCDE may include traditional metal electrode features. For example, if the voltage is very high, it may be desirable to have an HCDE including a combination of metal tips along with carbon fibers.

Example 2

Sample preparation. Two types of HCDE electrodes were used with the collection efficiency tests. Prepreg HCDE samples were synthesized using autoclave while hand lay-up HCDE samples were made using hand lay-up vacuum bagging. AS4 3 k plain weave carbon fiber cloth and epoxy (Fibre Glast 2000 with 2120 hardener) were used to synthesize the hand lay-up HCDE samples. The hand lay-up HCDE samples were fabricated under both pressure and vacuum, which make the process similar to the autoclave manufacturing except the heating. Prepreg HCDE samples were made out of twill weave AS4 carbon fiber sheets and epoxy system. All of the 304 stainless steel wire mesh sheets inserted between carbon layers were sandblasted in order to increase the interfacial bonding between the carbon fiber sheets and the stainless steel mesh.

In the first step, the carbon fiber and wire mesh layers were stacked, three metal mesh inserted between four carbon fiber layers, on top of flat metal mold which was coated with a high temperature mold release agent. In the next step, the HCDE laminate was covered with a release film, a breather, and a vacuum bag, respectively. Afterward, the layers of the HCDE were compressed using vacuum. Two vacuum ports were positioned at the corners of the mold. The first one was used as the vacuum source while the other one was used to measure it. At the final stage, the layers of the HCDE were cured using an autoclave at a temperature of 200° F. for 2.5 hours and under a pressure of 0.4 MPa. To monitor the curing process, thermocouples and pressure gauges were attached to the HCDE laminate. The thermocouples were placed at different places on the laminate to observe the temperature homogeneity during curing. For the hand lay-up, the same stacking methods were used.

The main differences between the fabrication processes of the hand lay-up HCDE and the prepreg HCDE are that, in the latter, 1) the fiber sheets were homogeneously pre-impregnated with epoxy resin and 2) the resin cured under elevated temperatures and under vacuum and pressure inside an autoclave. After curing, both types of HCDE samples were cut to be 1.25 inch wide using a manual shear machine. It is expected that the use of autoclave uniformly packed the layers of HCDEs. Also, it decreased the thickness of the highly resistive resin layer and reduced cavities in the laminate. Direct contact between the conductive metal mesh and the carbon fiber will most likely decrease the electrical resistivity of the prepreg HCDEs due to the formation of conductive path between the HCDE layers.

Sample testing. The two types of HCDE electrodes and, for comparison, rigid discharge electrodes (RDEs) were tested inside a pilot ESP chamber. All electrodes were tested under the same conditions and the same configuration (ratio of electrodes gap to distance from grounded plate was 1:1). The tests with only one electric field (E) installed before the collection electrode (C) were designated EC tests, whereas tests with two electric field (before and after the collection electrode) were designated ECE tests. EC, ECE, and ECECE-ECECE tests were conducted. All of HCDE samples were positioned such that edges were pointing in the gas flow direction. The electrodes within the same electric field were attached to a custom-built glass fiber rig which had a tensioner mechanism. This mechanism kept the electrode under tension and allowed them to freely expand. The mechanism reduced vibration of the electrodes and prevented the electrodes from buckling.

Previous results showed that HCDE had the higher electrical performance at closer distances to grounded plate and increasing the gap between the electrodes substantially increased the discharge current. The results indicated that electrical performance of the four HCDE electrodes at 3 inch gap between them was the lowest, whereas increasing the gap between HCDE electrodes to be 5 and 7 inches substantially increased the discharge current to be the highest among all HCDE configurations at 3.5 inch from the cell. The improvement in the discharge current when the gap between the electrodes was increased is due to reduction in the interference of the electric field by neighboring electrodes. The results also showed that the HCDE sample at 5 inch gap between them generated higher current and voltages when compared to RDE electrode at 3.5 inch distance from cross-flow cell. At a four inch distance from the grounded plate, the discharge currents for RDE and HCDE samples were approximately equal. The HCDEs with 5 inch gap did not spark over at 4.5 and 5 inches distances from the grounded plate. For the four HCDE electrodes with 7 inch gap configuration, the discharge current values were similar to the discharge current of RDE at 4 and 4.5 inches distances from grounded plate. Also, there was no significant drop in the discharge current values as the distance from the grounded plate increased. Increasing the gap between the electrodes increases the discharge current at larger distances from the grounded plate. For the same number of HCDEs, increasing the gap between the electrodes enhanced the discharge current while increasing the number of electrodes at small gap had minimal effect. Finally, the results showed that the HCDE electrodes were more efficient at closer distances to the grounded plate. Thus, for this example, in each electric field, there were four HCDEs parallel to the flow direction with 5 inch gap and 5 inch distance from the grounded plate whereas two RDEs were installed in each electric field.

For all collection efficiency tests, fly ash type A (3 μm diameter) was used. All other variables such as temperature, humidity, and dust concentration were kept the same for all tests. The average power (voltage and current) during the dust collection test as well as number of the sparks per minute (SPM) were recorded during tests. The sampling device (MIE ADR-1500 PM unit) was placed at the inlet and the outlet of the pilot ESP. The tests conducted with this instrument are denoted as PM tests. The sampling probe was placed in 9 different positions along the width and the height of both the inlet and the outlet ducts. The sampling time for each point was 3 minutes. The duration of each collection efficiency test was approximately 45 minutes.

Tables 3 and 4 below list the particulate collection efficiencies along with the average values of maximum discharge voltages and currents during the tests. Each test was conducted two times and the average values were reported in Tables 3 and 4.

TABLE 3

PM unit collection efficiency tests

| Electrode Type | Configuration | Spacing (inch) | Dropout η (%) | Total η (%) | ESP η (%) |
|---|---|---|---|---|---|
| Hand lay-up HCDE | EC | 5 | 31.66 | 49.7 | 18.0 |
| Prepreg HCDE | EC | 5 | 17.52 | 50 | 32.5 |
| Hand lay-up HCDE | ECE | 5 | 31.66 | 62.8 | 31.0 |
| Prepreg HCDE | ECE | 5 | 17.52 | 56.1 | 38.6 |
| RDE | ECE | 4.5 | 31.66 | 63.4 | 31.7 |
| RDE | ECE | 5 | 24.8 | 57.2 | 32.4 |
| Prepreg HCDE | ECECE-ECECE | 5 | 17.52 | 74.2 | 56.7 |

TABLE 4

Maximum voltage and current values during PM unit collection efficiency test

| Electrode Type | Configuration | Voltage (kV) | Current (mA) | SPM |
|---|---|---|---|---|
| Hand lay-up HCDE | EC | 69.17 | 6.11 | 4.56 |
| Prepreg HCDE | EC | 70 | 3 | 0 |
| Hand lay-up HCDE | ECE | 68.55 | 8.66 | 7.65 |
| Prepreg HCDE | ECE | 70 | 6 | 0 |
| RDE at 4.5" | ECE | 67.76 | 10.1 | 7.45 |
| RDE at 5" | ECE | 60.125 | 8.1 | 6.5 |
| Prepreg HCDE | ECECE-ECECE | 61[1] | 16.9 | 0 |

[1]Voltage limit was applied to the T/R unit

The results indicated that prepreg HCDE electrode had the highest ESP collection efficiency. Also, there was no sparking (0 SPM). Since the prepreg HCDE had no voltage breakdown (0 SPM), the dust particles charging process is expected be more efficient.

During the test, it was observed that RDE produced arcing, which affected the performance of cross flow system. The results indicated that the prepreg HCDE achieved higher ESP collection efficiencies with the advantage of having no arcing or sparking. Finally, the uniformity of the discharge current and the zero-sparking of HCDE are expected to be the reason for higher ESP collection efficiencies.

The prepreg HCDE exhibited the highest electrical performance and comparable or higher particulate collection efficiency with the advantages of being corrosion resistant, lighter in weight, and lower in cost as compared to conventional metal electrodes. Also, the HCDE electrodes generated stable current with almost no sparks throughout the test whereas metal electrodes had current fluctuation and frequent sparking. Increasing the number of the HCDE electrodes at a closer gap between them had minimal effect on the electrical performance while increasing the gap between the electrodes substantially enhanced electrical performance. In addition, the use of HCDE will make the ESP compact and lighter in weight.

While specific embodiments have been described in considerable detail to illustrate the present invention, the description is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A hybrid composite discharge electrode comprising at least one metal layer and at least one carbon fiber layer, wherein the at least one metal layer is perforated or a mesh.

2. The electrode of claim 1, wherein there are at least two carbon fiber layers and the at least two carbon fiber layers and the at least one metal layer alternate.

3. The electrode of claim 1, wherein the at least one carbon fiber layer includes an epoxy.

4. The electrode of claim 3, wherein the epoxy is conductive.

5. The electrode of claim 1, wherein the at least one metal layer includes at least one metal discharge tip, and wherein the at least one carbon fiber layer and the at least one metal discharge tip provide dual corona sources.

6. The electrode of claim 1, wherein the at least one metal layer comprises a metal base including at least one discharge tip, the at least one carbon fiber layer at least partially covering the at least one discharge tip.

7. The electrode of claim 6, wherein the metal base includes more than one set of the discharge tips spaced along a length of the metal base.

8. The electrode of claim 1, wherein a cross-section of the hybrid composite discharge electrode is U-shaped or V-shaped.

9. An electrostatic precipitator comprising:

the electrode of any of the preceding claims; and a grounded collector.

10. A method of filtering particles from a gas stream comprising:

flowing the gas stream into the electrostatic precipitator of claim 9;

applying a voltage between the electrode and the grounded collector to ionize and separate the particles from the gas stream and to direct the separated particles towards the grounded collector; and collecting the separated particles.

11. A method of making a hybrid composite discharge electrode comprising:

combining at least one metal layer and at least one carbon fiber layer to form the hybrid composite discharge electrode, wherein the at least one carbon fiber layer includes a resin matrix, the at least one metal layer includes perforations, and combining includes forcing the resin matrix to flow into the perforations.

12. The method of claim 11, wherein the at least one carbon fiber layer comprises a pre-impregnated carbon fiber composites.

13. The method of claim 11, wherein combining includes one of hand lay-up vacuum bagging, compression molding, or open molding and curing by an autoclave.

14. The method of claim 11, wherein the at least one metal layer includes at least one metal discharge tip, wherein the at least one carbon fiber layer and the at least one metal discharge tip provide dual corona sources.

* * * * *